US007237513B2

(12) United States Patent
Pfeffinger et al.

(10) Patent No.: US 7,237,513 B2
(45) Date of Patent: Jul. 3, 2007

(54) INTERNAL COMBUSTION ENGINE FOR A MOTOR VEHICLE

(75) Inventors: Harald Pfeffinger, Tiefenbronn (DE); Heiko Sass, Tamm (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 11/334,046

(22) Filed: Jan. 18, 2006

(65) Prior Publication Data

US 2006/0157002 A1 Jul. 20, 2006

Related U.S. Application Data

(63) Continuation-in-part of application No. PCT/EP2004/007771, filed on Jul. 14, 2004.

(30) Foreign Application Priority Data

Jul. 19, 2003 (DE) ..... 103 32 947

(51) Int. Cl.
*F01P 3/00* (2006.01)
*F01P 5/10* (2006.01)

(52) U.S. Cl. ..... 123/41.29; 123/41.44

(58) Field of Classification Search ..... 123/41.44, 123/41.29, 41.47
See application file for complete search history.

(56) References Cited

U.S. PATENT DOCUMENTS

| | | | |
|---|---|---|---|
| 4,423,705 | A | 1/1984 | Morita et al. |
| 5,215,044 | A | 6/1993 | Banzhaf et al. |
| 6,343,572 | B1 | 2/2002 | Pfaff et al. |

FOREIGN PATENT DOCUMENTS

| | | | |
|---|---|---|---|
| DE | 28 41 555 | | 4/1980 |
| DE | 40 32 701 | | 6/1992 |
| EP | 0 894 953 | | 2/1999 |
| FR | 2519694 A | * | 7/1983 |

* cited by examiner

*Primary Examiner*—Noah P. Kamen
(74) *Attorney, Agent, or Firm*—Klaus J. Bach

(57) ABSTRACT

In an internal combustion engine for a motor vehicle, having a cylinder head and an engine block, each with a coolant inlet port and a coolant outlet port which is common to the cylinder head the engine block, a main coolant pump having an intake side connected to the coolant outlet port and a pressure side connected to a first control valve via which coolant reaches the inlet port of the cylinder head and the inlet port of the engine block depending on the temperature of the coolant, and to a method for operating such an internal combustion engine, wherein the main coolant pump is selectively actuated to pump the coolant through at least one of the cylinder head and the engine block or is shut down depending on the engine operating state.

13 Claims, 2 Drawing Sheets

INTERNAL COMBUSTION ENGINE FOR A MOTOR VEHICLE

This is a Continuation-In-Part Application of International Application PCT/EP2004/007771 filed Jul. 14, 2004 and claiming the priority of German application 103 32 947.1 filed Jul. 19, 2003.

BACKGROUND OF THE INVENTION

The invention relates to an internal combustion engine for a motor vehicle having a cylinder head with coolant inlet and outlet ports and an engine block with coolant inlet and outlet ports and a coolant pump having an inlet in communication with the outlet ports of the cylinder head and the engine block and an outlet in communication with the inlet ports of the cylinder head and the engine block and also to a method of operating such an internal combustion engine.

Laid-open patent application DE 28 41 555 A1 discloses an internal combustion engine which has a coolant inflow for an engine block and a coolant inflow for a cylinder head. A pump feeds coolant to a temperature-controlled valve. Depending on the design, the valve feeds coolant into the cylinder head and/or the engine block. A continuous flow through the cylinder head and through the engine block cannot be established until the coolant has reached operating temperature. Since the cooling fluid in the engine block is not circulated until the operating temperature is reached it can heat up very quickly, as a result of which the frictional losses which occur after a cold start decrease quickly. The quantity of cooling fluid which flows via the cylinder head heats up very quickly as a result of the heat generated by the combustion taking place in the cylinder head so that the internal combustion engine reaches the operating temperature after a short time as a result of the proposed coolant supply arrangement.

It is the object of the present invention to further shorten a heating time of an internal combustion engine after a cold start in order to reduce fuel consumption and exhaust gas emissions.

SUMMARY OF THE INVENTION

In an internal combustion engine for a motor vehicle, having a cylinder head and an engine block, each with a coolant inlet port and a coolant outlet port which is common to the cylinder head the engine block, a main coolant pump having an intake side connected to the coolant outlet port and a pressure side connected to a first control valve via which coolant reaches the inlet port of the cylinder head and the inlet port of the engine block depending on the temperature of the coolant, and to a method for operating such an internal combustion engine, wherein the main coolant pump is selectively actuated to pump the coolant through at least one of the cylinder head and the engine block or is shut down depending on the engine operating state.

The internal combustion engine according to the invention is distinguished by a main coolant pump which can be switched on and off. In order to ensure rapid heating of the cylinder head in a warming up phase, the coolant is not circulated in the internal combustion engine, i.e. the coolant in the engine block and in the cylinder head is stationary. The pump wheel of the main coolant pump is not driven. The engine oil is heated quickly, as a result of which its viscosity drops and the piston friction is reduced.

In one embodiment of the invention, the main coolant pump is driven mechanically and can be switched off by means of a clutch. A main coolant pump which is operatively connected to the crank shaft and driven thereby is provided. The drive is provided via a belt drive or positively locking elements such as, for example, gearwheels. In order to prevent the flow of coolant in the warming up phase of the internal combustion engine, the main coolant pump can be switched off. The switching off is carried out by means of a clutch such as a magnetic clutch, viscous clutch or a clutch which releases a frictional or positive locking engagement.

In another embodiment of the invention, the main coolant pump is driven electrically and the rotational speed can be controlled by means of a control device. Depending on the cooling demand of the internal combustion engine, the main coolant pump can be switched off completely or its rotational speed can be controlled and/or it can be switched on and off in a timed fashion.

Furthermore, a first control unit controls the operation depending on at least one of the parameters such as temperature of the coolant, coolant pressure, temperature of the combustion chamber, exhaust gas temperature, exhaust gas values, component temperature, oil temperature, passenger compartment temperature or external temperature. Depending on the operating state of the internal combustion engine, the first control unit feeds coolant into the cylinder head and/or into the engine block. The first control unit can be embodied as a thermostatic valve which is heated or unheated, an electrically actuated butterfly valve, solenoid valve or as an electrically actuated rotary slide valve. An electrically actuatable valve is activated by means of a control unit. The control unit processes the abovementioned temperature values, exhaust gas values and pressure values which are sensed by sensors and calculates when the first control unit is switched with respect to emission values and fuel consumption values. The pressure-dependent control of the flow through the engine block and/or the cylinder head can also be implemented with a pressure valve. The pressure valve may be used alone or in combination with the previously mentioned valves.

In a further embodiment of the invention, a web temperature sensor for sensing the temperature of the combustion chamber is arranged between the inlet valve and outlet valve in the cylinder head. The combustion chamber temperature has a decisive influence on the exhaust gas emission values of the internal combustion engine. Depending on the combustion chamber temperature the first control unit feeds coolant into the cylinder head and/or into the engine block. The web sensor is arranged in the web between an inlet valve and an outlet valve.

A second control unit may be provided which is connected to a coolant return flow line of the internal combustion engine and, depending on the temperature, returns the coolant to the intake duct of the main coolant pump either in a large circuit via an air/fluid cooler (radiator) or in a small circuit bypassing the air/fluid cooler, and furthermore a heating circuit line is provided through which a partial flow which is branched off a coolant return flow line of the internal combustion engine flows back to the main coolant pump by bypassing the second control unit, and in which an additional electric coolant pump is arranged.

Depending on the necessary flow of coolant, the additional electric coolant pump is used in addition to the main coolant pump or as a replacement for the switched-off main coolant pump. The rotational speed of the additional coolant pump can be controlled and/or said additional coolant pump can be switched on and off in a clocked fashion so that a certain coolant flow corresponding to the demand can be established.

In a further embodiment of the invention, a differential pressure valve is arranged between the second control unit and the main coolant pump. The differential pressure valve opens starting at a certain pressure and clears a line to the main coolant pump. Below this pressure, for example at low engine speeds, coolant therefore does not flow back through the small coolant circuit, i.e. the coolant preferably flows back to the coolant pump via the heating circuit. If the circulation of coolant is to take place at low temperatures exclusively via the additional coolant pump, the differential pressure valve prevents coolant from flowing back to the second control unit and prevents the coolant from flowing back to the intake duct of the additional coolant pump by bypassing the cylinder head and/or the engine block. The differential pressure valve thus comprises two functions, a priority circuit for the heating circuit and a return flow inhibitor. If the priority circuit function for the heating circuit is not needed, it is of course possible to use a simple non-return valve in its place.

In still a further embodiment of the invention, a heat exchanger for exhaust gas recirculation, passenger heating and/or engine oil is arranged in the heating circuit line. On the one hand, the recirculated exhaust gas flows through the heat exchanger for the exhaust gas recirculation and on the other hand coolant flows through the heat exchanger, as a result of which the exhaust gas is cooled before it is returned to the combustion chamber. The cooling of the recirculated exhaust gas reduces the proportion of nitrogen oxide in the emissions of the internal combustion engine. The heat exchanger for passenger compartment heating includes flow passages for the coolant and flow passages for the air, said air being heated in the heat exchanger and thus heating the passenger compartment. The heating capacity is regulated either by controlling the flow of coolant or the flow of air through the heat exchanger. A heat exchanger through which both engine oil and coolant flow is also provided for cooling the engine oil.

In a further embodiment of the invention, the heat exchanger for the passenger compartment is arranged in the heating circuit line and the heat exchangers for the exhaust gas recirculation and the engine oil are arranged in a coolant line which branches off downstream of the main coolant pump and upstream of the inflow port to the cylinder head and opens into a return flow line which extends from the internal combustion engine to the coolant pump. In this arrangement, the heat exchangers for the exhaust gas recirculation and the engine oil are supplied with cooled engine cooling water when the coolant flows through the air/fluid cooler.

In another embodiment of the invention, the heat exchanger for the passenger compartment and for the engine oil is arranged in the heating circuit line, and the heat exchanger for the exhaust gas recirculation is arranged in a coolant line which branches off downstream of the coolant pump and upstream of the inflow port of the cylinder head and opens into a return flow line of the internal combustion engine. The arrangement of the heat exchanger for the passenger heating upstream of the engine oil heat exchanger is advantageous since at first the passenger compartment is supplied with heat and less heat is transferred to the engine oil. The heat exchanger for the exhaust gas recirculation is supplied with cooled engine inlet water when there is a flow through the air/fluid cooler.

In a particular refinement of the invention, the heat exchanger for the passenger compartment is arranged in the heating circuit line, the heat exchanger for the exhaust gas recirculation is arranged in a coolant line which branches off downstream of the coolant pump and upstream of the inflow port of the cylinder head and opens into a return flow line which emerges from the internal combustion engine, and the heat exchanger for the engine oil is arranged in a coolant line which branches off downstream of the first control unit and upstream of the inflow port of the engine block and opens into a return flow line which emerges from the internal combustion engine. By means of the first control unit, the flow of coolant through the engine block and the engine oil heat exchanger which supplies the exhaust gas recirculation cooler with cooled engine inlet water when there is a flow through the air/fluid cooler can be switched off by the arrangement mentioned above.

In a further refinement of the invention, a transmission oil cooler is provided whose inflow is connected to a return flow line of the air/fluid cooler and to a return flow line of the heating circuit and whose outflow is connected to the intake side of the main coolant pump. The transmission oil flows through the transmission oil cooler and is cooled or heated by the coolant return flow of the air/fluid cooler and/or the return flow from the heating circuit line. When the internal combustion engine is cold, the coolant does not flow through the air/fluid cooler. As a result, only warm coolant from the heating circuit flows through the transmission oil cooler, said coolant contributing to the heating of the transmission oil. When the internal combustion engine has reached the operating temperature, in addition to the return flow from the heating circuit coolant for cooling the transmission oil also flows out of the air/fluid cooler into the gear oil heat exchanger. The coolant is to be extracted on the cold side or from a low temperature area of the air/fluid cooler.

The method according to the invention is distinguished by the fact that the main coolant pump (1) is switched off if the internal combustion engine does not require any cooling and the main coolant pump (1) is switched on and coolant is circulated in the cylinder head (7) and/or the engine block (8) if cooling is necessary. As a result of the circulation of coolant being switched off, the internal combustion engine heats up very quickly. When the internal combustion engine heats up further, the main coolant pump and/or additional coolant pump circulates the coolant and the first control unit feeds the coolant only to the cylinder head so that the oil in the engine block can continue to warm up and the frictional losses are reduced. When the operating oil temperature is reached, the coolant is fed both to the cylinder head and to the engine block by means of the first control unit.

In one refinement of the invention, an additional electric coolant pump is used in the method for increasing the flow of coolant. The mechanically driven main coolant pump requires very little coolant at low engine temperatures. It is disadvantageous that at low external temperatures only very little heat for heating the passenger compartment can be removed via the heat exchanger for the passenger compartment because of the low flow of coolant. In this case, the additional electric coolant pump is switched on according to demand in order to increase the flow of coolant.

In a further refinement of the method the main coolant pump is switched off and the coolant is circulated by means of the additional electric coolant pump. In one operating state in which no cooling or little cooling is necessary for the internal combustion engine, the main coolant pump is switched off. An additional electric coolant pump which has been switched on performs the function of circulating the coolant through the heat exchanger for the passenger compartment in order to maintain the heating of the passenger compartment.

The rotational speed of the additional electric coolant pump is controlled in such a way that the flow of coolant which is necessary for the heating demand of the passenger compartment or the cooling demand of the internal combustion engine is available.

The invention will become more readily apparent from the following description of particular embodiments thereof on the basis of the accompanying drawings.

DESCRIPTION OF THE VARIOUS EMBODIMENTS

Identical parts in the FIGS. 1 to 4 are designated below by the same reference symbols.

Figure 1:
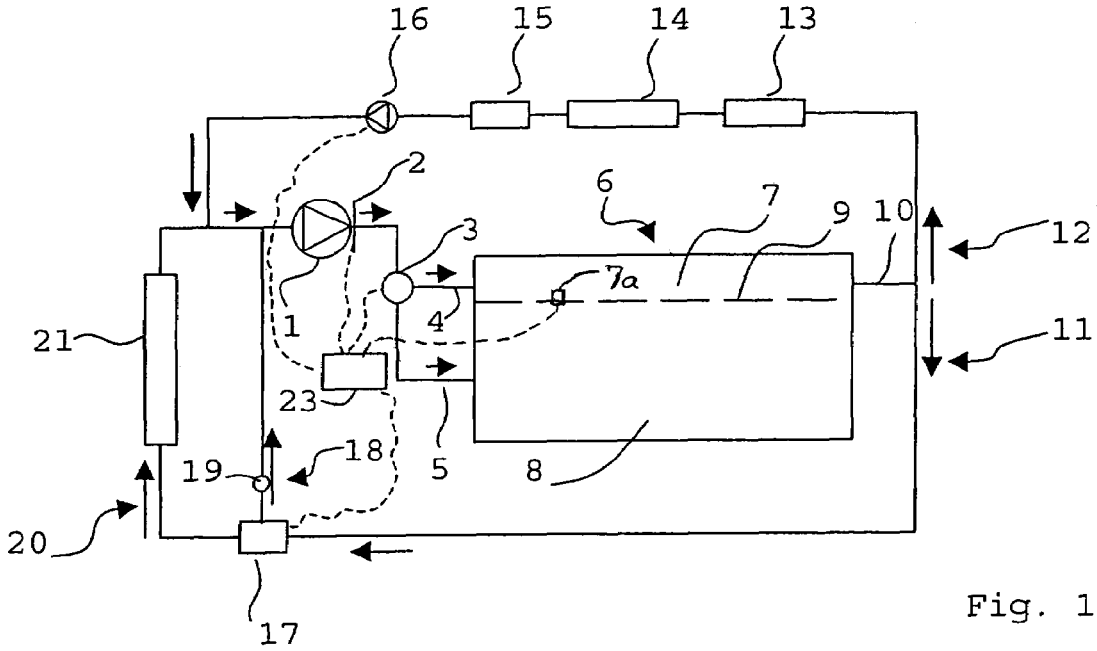
FIG. 1 shows a first embodiment of the coolant circuit of an internal combustion engine according to the invention.

The schematic illustration in FIG. 1 shows an internal combustion engine 6 which is provided with a cooling circuit. The direction of flow of a coolant in the cooling circuit is indicated in each case by an arrow at various points. The coolant which circulates in the cooling circuit flows from the main coolant pump 1 through the assemblies as will be described below.

The main coolant pump 1 which is operatively connected to a crank shaft (not shown) of the internal combustion engine 6 circulates the cooling fluid in the cooling circuit. In the embodiment shown, the main coolant pump 1 can be decoupled mechanically. The drive of the main coolant pump 1 is provided by means of a belt, i.e. a V-belt or toothed belt or by means of gearwheels.

By activating a clutch 2, the main coolant pump can be disconnected from the drive. The clutch 2 can be actuated electrically and can be switched on or off by means of a magnetic clutch mechanism, for example.

The main coolant pump 1 may also be an electric pump. The rotational speed can be adjusted from zero to the maximum rotational speed, i.e. in this embodiment there is no need for a mechanical clutch 2 to switch off the main coolant pump 1. Furthermore, the electric main coolant pump 1 can be actuated independently of the engine speed. The pump can be actuated in such a way that it supplies precisely the necessary demand for coolant.

The coolant flows from the main coolant pump 1 to a first control unit 3. The first control unit 3 is connected to two inflow ports of an internal combustion engine. The first inflow port 4 feeds the coolant into a cylinder head 7, and the second inflow port 5 feeds it into an engine block 8. Depending on the operating state, the first control unit 3 feeds the coolant to the cylinder head 7 or to the engine block 8. The first control unit 3 is embodied as an electrically actuated valve.

The internal combustion engine 6 generates both mechanically usable energy and a high proportion of excess thermal energy by burning a gas/air mixture. In order to prevent the internal combustion engine 6 from overheating, a coolant which flows through the internal combustion engine 6 absorbs the excess heat and transmits it to the surroundings via an air/fluid cooler (radiator) 21. In the embodiment shown, coolant is exchanged between the engine block 8 and cylinder head 7 via a cylinder head gasket 9. If the first control unit 3 opens only the inflow for the engine block 8, the coolant flows into the engine block 8 and then via the cylinder head gasket 9 into the cylinder head 7, and out of the internal combustion engine 6 via a return flow opening 10 on the cylinder head 7. If the first control unit 3 opens only the inflow to the cylinder head 7, the coolant flows through the cylinder head 7 to the return flow opening 10. If the first control unit 3 opens the inflow for the cylinder head 7 and the engine block 8, some of the coolant flows via the engine block 8 and the cylinder head 7 to the return flow opening 10, and the rest flows through the cylinder head 7 to the return flow opening 10. To determine the temperature of the combustion chamber a temperature sensor 7*a* (web sensor) is disposed in the cylinder head in a web between an inlet and an outlet valve of the cylinder head (7).

In a modified embodiment (not illustrated), the internal combustion engine 6 has completely separate cooling circuits for the engine block 8 and cylinder head 7, i.e. coolant is not exchanged via the cylinder head gasket 9. The engine block 8 and cylinder head 7 then each have a return flow opening for the coolant. The coolant which flows out from the two return flow openings collects in a common line which leads on.

The coolant emerging from the internal combustion engine flows partially into a heating circuit 12 and partially into a cooling circuit 11.

The heating circuit 12 is described in the following section. In FIG. 1, an exhaust gas recirculation cooler 13 is arranged in the heating circuit, downstream of the internal combustion engine. Exhaust gas recirculation coolers 13 are used in diesel engines. By cooling the exhaust gas which is fed again to the combustion chambers, the combustion temperature and thus the $NO_x$ content of the exhaust gas are reduced. The high temperature exhaust gases transmit thermal energy to the coolant in the exhaust gas recirculation cooler 13.

Furthermore, a heat exchanger which serves to heat a passenger compartment is arranged downstream in the heating circuit. When there is a requirement for the passenger compartment to be heated, the heat exchanger for the passenger compartment 14 extracts thermal energy from the coolant and feeds it to the passenger compartment.

Also, the lubrication oil absorbs some of the waste heat of the internal combustion engine 6. In relatively powerful motors, the cooling of the engine oil by means of an oil sump is no longer sufficient to maintain the maximum admissible lubricating oil temperature so that an engine oil/coolant heat exchanger, referred to below as engine oil cooler 15, is used and it extracts heat from the lubricating oil and feeds it to the coolant. The engine oil cooler 15 is arranged downstream of the heat exchanger for the passenger compartment 14 in FIG. 1.

An additional coolant pump 16 is positioned downstream of the engine oil cooler 15 in the direction of flow. It is driven electrically and can be switched on depending on the operating state. The use of an additional coolant pump 16 is preferably to be provided in combination with a mechanical, engine-speed-dependent main coolant pump 1 which cannot be controlled. The circulation of coolant can be controlled in accordance with the coolant demand of the internal combustion engine 6 by means of the additional coolant pump 16.

Some of the coolant which emerges from the internal combustion engine 6 flows into a small cooling circuit 18 or into a large cooling circuit 20, which are described below. The coolant flows from the return flow opening 10 of the internal combustion engine 6 to a second control unit 17. The second control unit 17 returns the coolant, depending on the coolant temperature, to the intake side of the main coolant pump 1 in a large cooling circuit 20 via an air/fluid cooler (radiator) 21 or via a small cooling circuit 18 bypassing the air/fluid cooler 21. The second control unit 17 may have an expandable element (thermostat) which switches over from the small cooling circuit 18 to the large cooling circuit 20 starting from a specific coolant temperature. Alternatively, the second control unit 17 can also be heated or embodied as an electrically actuated mixing valve.

In the small cooling circuit 18, a differential pressure valve 19 is arranged between the second control unit 17 and the intake side of the main coolant pump 1. If the pressure downstream of the second control unit 17 is low at low coolant temperatures, the differential pressure valve 19 shuts off the flow. Starting from a certain minimum pressure, the differential pressure valve 19 opens and permits the return flow to the coolant pump 1.

A control unit 23 processes the values sensed by sensors (not shown) relating to pressure, temperature, exhaust gas etc., determines from them the optimum operating conditions and switches the first control valve 3, the second control valve 17 and, if they can be actuated electrically, the clutch 2 of the main coolant pump 1 and the rotational speed of the additional coolant pump 16, and correspondingly actuates them. The control unit 23 is preferably integrated in a control unit which is responsible for controlling the engine.

In supercharged engines, an air/water supercharging air cooler is arranged in the cooling circuit in a modified embodiment (not shown). The increase in density which is achieved as the supercharging temperature drops gives rise to a higher power owing to an improved cylinder charge. Furthermore, the lower temperature reduces the thermal loading of the engine and provides for lower $NO_x$ emissions in the exhaust gas. The intake air which is compressed in the supercharger supplies thermal energy to the cooling fluid in the supercharged air cooler.

With the arrangement shown in FIG. 1, the flow of the coolant through the internal combustion engine 1 can be influenced in accordance with the operating temperature in such a way that the emissions are reduced. When the internal combustion engine 1 is cold, there is no need for cooling and the main coolant pump 1 is switched off by means of the clutch 2. So that the passenger compartment can be heated at low ambient temperatures, an additional electric coolant pump 16 feeds coolant through the cylinder head 7 and the heating circuit 12 when necessary. The differential pressure valve 19 prevents the coolant from flowing past the cylinder head 7 via the small cooling circuit 18 counter to the direction of flow shown. Switching off the main coolant pump 1 reduces the power loss through secondary assemblies of the internal combustion engine, and as a result the fuel consumption and exhaust gas emissions are reduced. Since there is no circulation of the coolant, the engine oil can also heat up more quickly and the period of time in which high frictional losses occur because of cold engine oil is shortened. This makes a further contribution to reducing the fuel and emissions after a cold start.

Upon further heating of the internal combustion engine 1 and the necessity to cool the cylinder head 7 because of high combustion chamber temperatures, the main coolant pump 1 is switched on. Web sensors which are arranged (not shown) between the inlet and outlet valves of the internal combustion engine 1 measure the combustion chamber temperature and transfer the values to the control unit 23 which triggers the switching-on of the main coolant pump. At the same time, the first control unit 3 only feeds coolant to the cylinder head and the engine coolant in the engine block 8 can continue to heat up. Alternatively, in this phase the additional coolant pump 16 can also perform the function of circulating the coolant while the main coolant pump 1 remains switched off. However, in this case the additional coolant pump 16 must have correspondingly larger dimensions. The differential pressure valve 17 also prevents the coolant from flowing past the cylinder head 7 via the small cooling circuit 18.

If the further heating of the internal combustion engine 1 requires the engine block 8 to be cooled, the first control unit 3 also feeds coolant to the engine block 8. The stream of coolant through the engine block 8 can be varied between zero and the maximum volume flow supplied by the coolant pumps. As a result, different temperatures at the cylinder head 7 and engine block 8 can be set. The temperature of the cylinder head 7 and the temperature in the combustion chamber are preferably as low as possible so that low emission values can be achieved. The temperature in the engine block 8 should have an operating temperature of approximately 80° C. so that low frictional losses occur.

As the coolant is further heated, the second control unit 17 opens so that the coolant is cooled in the large cooling circuit 20 via the air/fluid cooler 21 and is not heated up any further.

Figure 2:
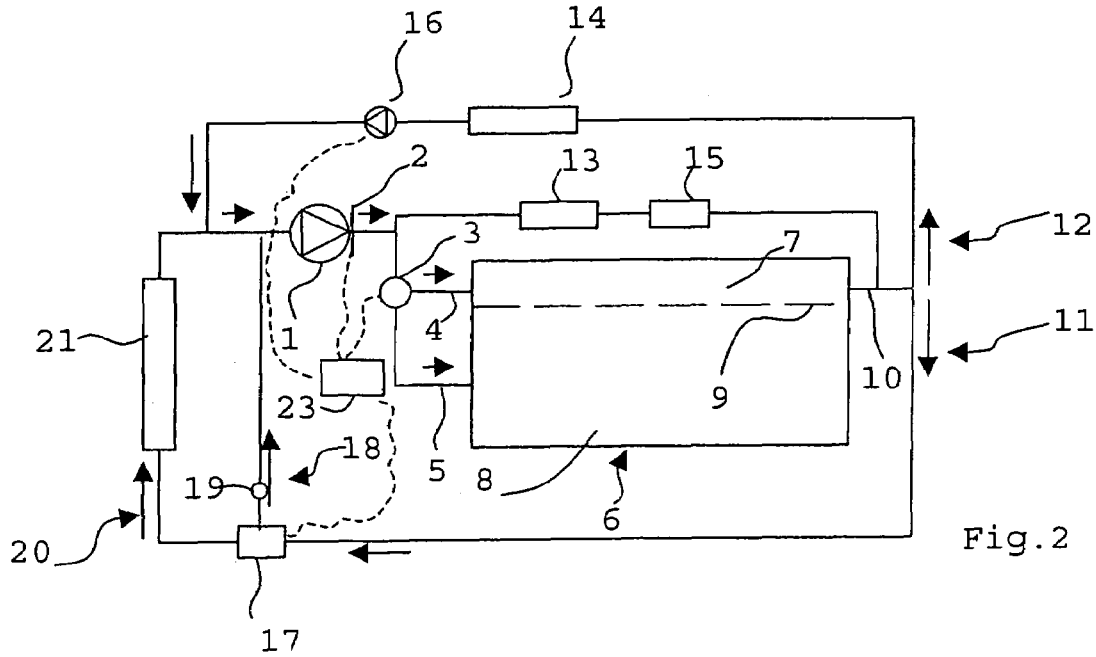
FIG. 2 shows a second embodiment of the coolant circuit of the internal combustion engine according to the invention.

FIG. 2 shows a coolant circuit with an arrangement of the exhaust gas recirculation cooler 13 and of the engine oil cooler 15 which is changed with respect to FIG. 1. In this embodiment, the exhaust gas recirculation cooler 13 and the engine oil cooler 15 are supplied with colder cooling water which has not yet been heated by the internal combustion engine 6. If there is no need for the passenger compartment to be heated, in this arrangement the heating circuit 12 can be shut off without the flow of coolant of the other coolers being adversely affected.

Figure 3:
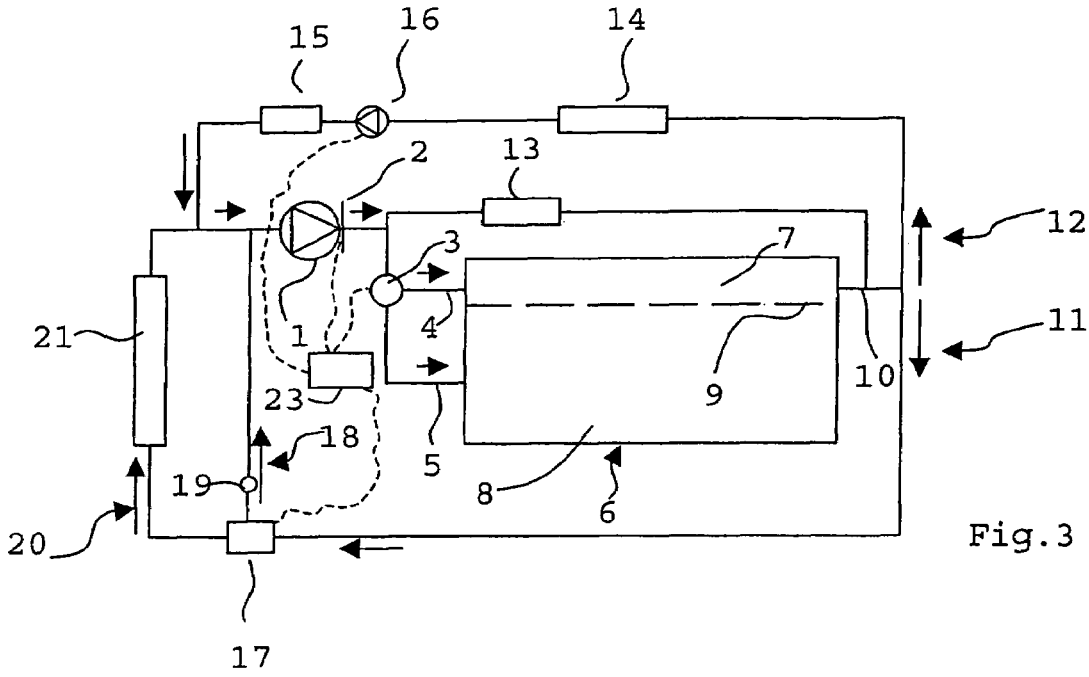
FIG. 3 shows a third embodiment of the coolant circuit of the internal combustion engine according to the invention.

In FIG. 3, the exhaust gas recirculation cooler 13 is arranged directly downstream of the main coolant pump 1, and the engine oil cooler 15 is arranged in the heating circuit 12 downstream of the heat exchanger for the passenger compartment 14. When there is a flow through the air/fluid cooler, the exhaust gas recirculation cooler 13 is supplied with cold cooling water which has not yet been heated by the internal combustion engine 1, as a result of which the $NO_x$ emission values can be reduced in an optimum way. The arrangement of the engine oil cooler 15 in the heating circuit 12 downstream of the heat exchanger for the passenger compartment leads to better heating comfort since where necessary the coolant uses the heat firstly for supplying the passenger compartment and then for heating the engine oil.

Figure 4:
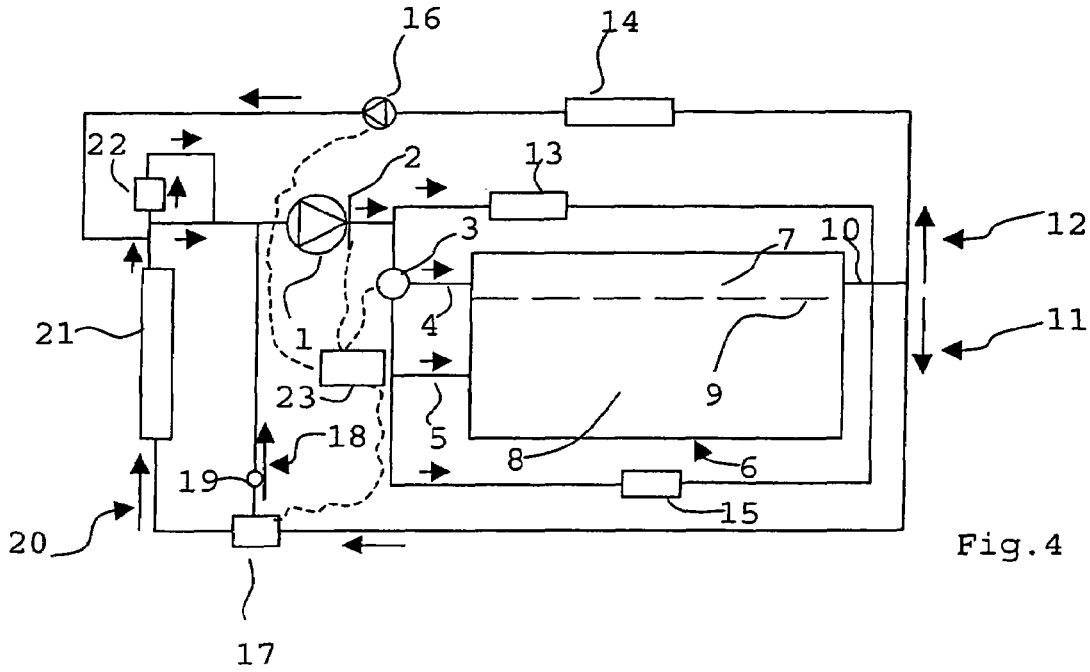
FIG. 4 shows a fourth embodiment of the coolant circuit of the internal combustion engine according to the invention.

FIG. 4 shows an arrangement of a transmission oil cooler 22 and the arrangement of an engine oil heat exchanger 15 parallel to the engine block 8. In addition to the internal combustion engine 1, a transmission (not shown) which is used in motor vehicles generates heat losses. In order to avoid overheating the transmission oil, it is cooled by means of a transmission oil cooler 22. Both the coolant of the internal combustion engine 1 and the transmission oil flow through the transmission oil cooler 22. In the transmission oil cooler 22, the transmission oil transmits heat to the coolant. The inlet of the transmission oil cooler 22 is connected to a return flow line of the air/fluid cooler 21, and the return flow line of the heating circuit 12, and the coolant return flow opening of the transmission oil cooler 22 is connected to the intake side of the main coolant pump 1. The air/fluid cooler 21 can also be provided with a low temperature area. The air/fluid cooler 21 then has two return flows, one from the low temperature area and one from the normal temperature area. The transmission oil cooler 22 is advantageously connected to the return flow from the low temperature area of the air/fluid cooler 21, as a result of which area cooling of the transmission oil is improved. The return flow from the normal temperature area is connected to the intake side of the main coolant pump 1. In the phase in which the second flow control unit 17 permits the flow of coolant only in the small cooling circuit 18 when the internal combustion engine 1 is cold, the coolant flowing out of the heating circuit into the transmission oil cooler 22 heats the transmission oil, and the inflow from the air/fluid cooler 21 is prevented by the second control unit 17. Heating the transmission oil reduces the frictional losses in the transmission. As soon as the second control unit 17 clears the flow of coolant through the air/fluid cooler 21 when the engine operating temperature has been reached, the transmission oil is cooled with a coolant mix from the heating circuit 12 and the air/fluid cooler 21.

The arrangement of the transmission oil cooler can basically also be formed with the heating circuits in FIG. 1 to FIG. 3. The transmission may be a manual or automatic shift transmission. In FIG. 4, the engine oil cooler 15 is connected parallel to the engine block 8. If there is no flow through the engine block 8 owing to the position of the first flow control unit 3, it is not possible to transfer heat from the engine oil to the transmission oil, i.e. the engine oil can heat up essentially without being influenced by the transmission oil temperature.

What is claimed is:

1. An internal combustion engine (6) for a motor vehicle, comprising a cylinder head (7) with a coolant inlet port (4) and a coolant return flow port (10), an engine block (8) with a coolant inlet port (5) and a coolant return flow port (10) common to the cylinder head (7) and the engine block (8), a main coolant pump (1) having an intake side which is connected to the coolant return flow port (10) and a pressure side which is connected to a first flow control unit (3) for controlling admission of coolant to the inlet port (4) of the cylinder head (7) and the inlet port (5) of the engine block (8), the main coolant pump (1) being switchable on and off depending on the cooling requirement for the cylinder head (7) and the engine block (8), a second flow control unit (17) disposed in a coolant return line of the internal combustion engine (6) for returning the coolant, depending on the temperature, to the intake of the main coolant pump (1) selectively either in a large circuit (20) which includes an air/fluid cooler (21) or in a small circuit (18) which bypasses the air/fluid cooler (21), a heating circuit line (12) which is branched off from a coolant return flow line of the internal combustion engine (6) for conducting part of the coolant back to the main coolant pump (1) bypassing the second flow control unit (17), and an additional electric coolant pump (16) arranged in the heating circuit line (12).

2. The internal combustion engine for a motor vehicle as claimed in claim 1, wherein the main coolant pump (1) is driven mechanically and a clutch (2) is provided for switching off the coolant pump (1).

3. The internal combustion engine for a motor vehicle as claimed in claim 1, wherein the main coolant pump (1) is driven electrically and the rotational speed of the main coolant pump is controllable depending on the temperature of the coolant.

4. The internal combustion engine for a motor vehicle as claimed in claim 1, wherein the first flow control unit (3) switches depending on at least one of the parameters consisting of temperature of the coolant, the coolant pressure, the temperature of the combustion chamber, the exhaust gas temperature, the exhaust gas values, the component temperature, the oil temperature, the passenger compartment temperature and the ambient external temperature.

5. The internal combustion engine for a motor vehicle as claimed in claim 4, wherein a web sensor for sensing the temperature of the combustion chamber is arranged between the inlet valve and outlet valve in the cylinder head (7).

6. The internal combustion engine for a motor vehicle as claimed in claim 1, wherein a differential pressure valve (19) is arranged between the second flow control unit (17) and the main coolant pump (1).

7. The internal combustion engine for a motor vehicle as claimed in claim 1, wherein at least one of an exhaust gas recirculation heat exchanger (13), a passenger compartment heater (14) and an engine oil heat exchanger (15) are arranged in the heating circuit line (12).

8. The internal combustion engine for a motor vehicle as claimed in claim 1, wherein a passenger compartment heat exchanger (14) is arranged in the heating circuit line (12), and the heat exchangers for the exhaust gas recirculation (13) and the engine oil (15) are arranged in a coolant line which branches off the coolant supply line to the engine downstream of the main coolant pump (1) and upstream of the inlet port of the cylinder head (4) and which opens into a return flow line extending from the outlet of the internal combustion engine (6) to the main coolant pump (1).

9. The internal combustion engine for a motor vehicle as claimed in claim 1, wherein heat exchangers for the passenger compartment (14) and for the engine oil (15) are arranged in the heating circuit line (12), and the heat exchanger for the exhaust gas recirculation (13) is arranged in a coolant line which branches off the coolant supply line to the engine downstream of the main coolant pump (1) and upstream of the inflow port of the cylinder head (3) and which extends to a return flow line for returning the coolant to the main coolant pump (1) of the internal combustion engine (6).

10. The internal combustion engine for a motor vehicle as claimed in claim 1, wherein a heat exchanger for the passenger compartment (14) is arranged in the heating circuit (12), a heat exchanger for the exhaust gas recirculation (13) is arranged in a coolant line which branches off downstream of the main coolant pump (1) and upstream of the inlet port of the cylinder head (4) of the engine and opens into a return flow line which emerges from the internal combustion engine (6), and a heat exchanger for the engine oil (15) is arranged in a coolant line which branches off downstream of the first control valve (3) and upstream of the inlet port of the engine block (5) and opens into a return flow line of the internal combustion engine (6).

11. The internal combustion engine for a motor vehicle as claimed in claim 1, wherein a transmission oil cooler (22) is provided with an inlet connected to a return flow line of the air/fluid cooler (21) and to a return line of the heating circuit (12) and an outlet connected to the intake side of the main coolant pump (1).

12. A method for operating an internal combustion engine for a motor vehicle, comprising:

a cylinder head (7) with a coolant inlet port (4) and a coolant return flow port (10), a engine block (8) with a coolant inlet port (5) and a coolant return flow port (10) common to the cylinder head (7) and the engine block (8), a main coolant pump (1) having an intake side which is connected to the coolant return flow port (10) and a pressure side which is connected to a first flow control unit (3) for controlling admission of coolant to the inlet port (4) of the cylinder head (7) and the inlet port (5) of the engine block (8), the main coolant pump (1) being switchable on and off depending on the cooling requirement for the cylinder head (7) and the engine block (8), said method comprising the steps of:

switching the main coolant pump (1) off if the internal combustion engine does not require any cooling, switching the main coolant pump (1) on so that coolant is circulated through at least one of the cylinder head (7) and the engine block (8) if cooling is necessary and, increasing the coolant flow by the operation of an additional electric coolant pump (16) disposed in the heating circuit (12).

13. The method as claimed in claim 12, wherein the main coolant pump (1) is switched off and the coolant is circulated by means of the additional electric coolant pump (16), when the flow volume of the main coolant pump (1) is not needed.

* * * * *